US007210180B2

(12) United States Patent
Malcolm

(10) Patent No.: US 7,210,180 B2
(45) Date of Patent: May 1, 2007

(54) SURGICAL TABLE WIDTH EXTENSION AND ANGULARLY ORIENTABLE ATTACHMENT

(76) Inventor: Roger J. Malcolm, 970-B Calle Amanecer, San Clemente, CA (US) 92673

( * ) Notice: Subject to any disclaimer, the term of this patent is extended or adjusted under 35 U.S.C. 154(b) by 140 days.

(21) Appl. No.: 10/969,506

(22) Filed: Oct. 20, 2004

(65) Prior Publication Data

US 2005/0081295 A1 Apr. 21, 2005

Related U.S. Application Data

(60) Provisional application No. 60/550,991, filed on Mar. 4, 2004, provisional application No. 60/513,137, filed on Oct. 20, 2003.

(51) Int. Cl.
*A61G 13/12* (2006.01)

(52) U.S. Cl. ..... 5/658; 5/663; 5/621

(58) Field of Classification Search ..... 5/658, 5/661, 663, 503.1, 507.1, 621–624
See application file for complete search history.

(56) References Cited

U.S. PATENT DOCUMENTS 3,967,126 A * 6/1976 Otto, Jr. ..... 378/177
4,064,401 A * 12/1977 Marden ..... 5/601
4,506,872 A * 3/1985 Westerberg et al. ..... 5/601
4,669,136 A * 6/1987 Waters et al. ..... 5/601
5,276,927 A * 1/1994 Day ..... 5/622
5,628,078 A * 5/1997 Pennington et al. ..... 5/618
5,754,997 A * 5/1998 Lussi et al. ..... 5/618
5,758,374 A * 6/1998 Ronci ..... 5/507.1
6,022,143 A * 2/2000 Helmreich ..... 378/181
6,023,800 A * 2/2000 Stickley ..... 5/621
6,195,820 B1 * 3/2001 Heimbrock et al. ..... 5/623
6,336,412 B2 * 1/2002 Heimbrock et al. ..... 108/42
6,378,149 B1 * 4/2002 Sanders et al. ..... 5/624
6,499,158 B1 * 12/2002 Easterling ..... 5/600
6,598,275 B1 * 7/2003 Kolody et al. ..... 24/455
6,671,904 B2 * 1/2004 Easterling ..... 5/601
6,678,908 B2 * 1/2004 Borders et al. ..... 5/691
6,895,617 B2 * 5/2005 Zacharopoulos et al. ..... 5/601
6,912,959 B2 * 7/2005 Kolody et al. ..... 108/28
6,944,897 B2 * 9/2005 Koch ..... 5/621
2001/0044971 A1 * 11/2001 Borders et al. ..... 5/691
2003/0061660 A1 * 4/2003 Easterling ..... 5/600

(Continued)

*Primary Examiner*—Robert G. Santos
(74) *Attorney, Agent, or Firm*—Charmasson, Buchaca & Leach, LLP

(57) ABSTRACT

A surgical table width extender having an angled tang structure for engaging the gap formed between a standard table and its stand-off-mounted side rail. The tang structure contacts portions of the rail and portions of the table edge to enhance the load-carrying capability of the table side rail assembly. The extender further provides its own stand-off-mounted rail and a quick release clamp for securing the extender to the table. The tang structure is formed to allow a single extender to be used on either side of a surgical table where the stand-offs are not evenly spaced apart. The extender body is formed from a lightweight, strong carbon fiber composite material. Further enhancements protect exposed corners of the extender and protect potential high stress surfaces. An angularly orientable attachment is provided for use when two width extenders are used simultaneously on opposite sides of the table. In a lowered, horizontal orientation the attachment acts as a table length extender. In a raised, upright orientation the attachment acts as a foot stop.

22 Claims, 6 Drawing Sheets

U.S. PATENT DOCUMENTS

2003/0155478 A1* 8/2003 Easterling ..... 248/316.1
2003/0205176 A1* 11/2003 Kolody et al. ..... 108/28
2004/0088793 A1* 5/2004 Koch ..... 5/621
2005/0081295 A1* 4/2005 Malcolm ..... 5/624

* cited by examiner

SURGICAL TABLE WIDTH EXTENSION AND ANGULARLY ORIENTABLE ATTACHMENT

PRIOR APPLICATION

This application claims the benefit of U.S. Provisional Patent Application Ser. No. 60/513,137 filed Oct. 20, 2003, and 60/550,991 filed Mar. 4, 2004.

FIELD OF THE INVENTION

This invention relates to medical devices and more particularly to surgical tables and their attachments.

BACKGROUND OF THE INVENTION

Specialized tables have long been used to support and immobilize individuals so that doctors can readily access body parts of interest during surgery or other treatments. So-called surgical tables come with a number of mechanical enhancements to further this purpose. Many such tables are articulatable to support patients in a supine, sitting or other orientations. Many such tables come equipped with side rails mounted along the lateral edges of the table so that various devices and attachments can be secured to the table, including devices such as arm and head immobilizers, and equipment platforms. The rails are mounted to the edge of the table on a number of spaced-apart stand-offs which form a gap between the rail and the table edge of about 1 to 3 centimeters.

Because of their ruggedness and adaptability, and the number of features provided by these tables, the tables are often expensive. It is difficult for hospitals and other health care institutions to purchase a number of tables for different-sized individuals. Since many individual's weight exceeds three or four hundred pounds, most standard-sized surgical tables have an upper surface which is too narrow to adequately support such individuals.

This has prompted the development of detachable platforms for increasing the upper surface of the table. Existing platforms typically mount directly to the rails without contacting any other portion of the table. Therefore, the load to be carried by the platform must be exclusively borne by the rail/stand-off assembly. Many platforms also leave a gap between the table surface and the platform which can be uncomfortable and provide reduced support. Further, these platforms take up valuable rail space which may otherwise have been used for other attachments.

There is, therefore, a need for a device which increases the usable upper surface of a surgical table without detracting from its utility.

SUMMARY OF THE INVENTION

The principal and secondary objects of this invention are to provide a device for increasing the usable upper surface area of a surgical table.

These and other objects are achieved by a table width extender having an angled tang structure for engaging the gap formed between a standard table and its stand-off-mounted side rail. The tang structure contacts portions of the rail and portions of the table to enhance rather than decrease the load-carrying capability of the table side rail/stand-off assembly. The extender further provides its own stand-off-mounted rail and a quick release clamp for securing the extender to the table in any table orientation. The tang structure is formed to allow a single extender to be used on either side of a surgical table where the stand-offs are not evenly spaced apart. By engaging the gap between the table and its rail, the spacing between the upper surface of the table and the upper surface of the extender is reduced. The extender body is formed from a lightweight, strong carbon fiber composite material. Further enhancements protect exposed corners of the extender and protect potential high stress surfaces. An angularly orientable attachment is provided for use when two width extenders are used simultaneously on opposite sides of the table. In a lowered, horizontal orientation the attachment acts as a table length extender. In a raised, upright orientation the attachment acts as a foot stop. The attachment is formed from a lightweight, strong carbon fiber composite material. Further enhancements protect exposed edges and corners.

DESCRIPTION OF THE PREFERRED EMBODIMENT OF THE INVENTION

Figure 1:
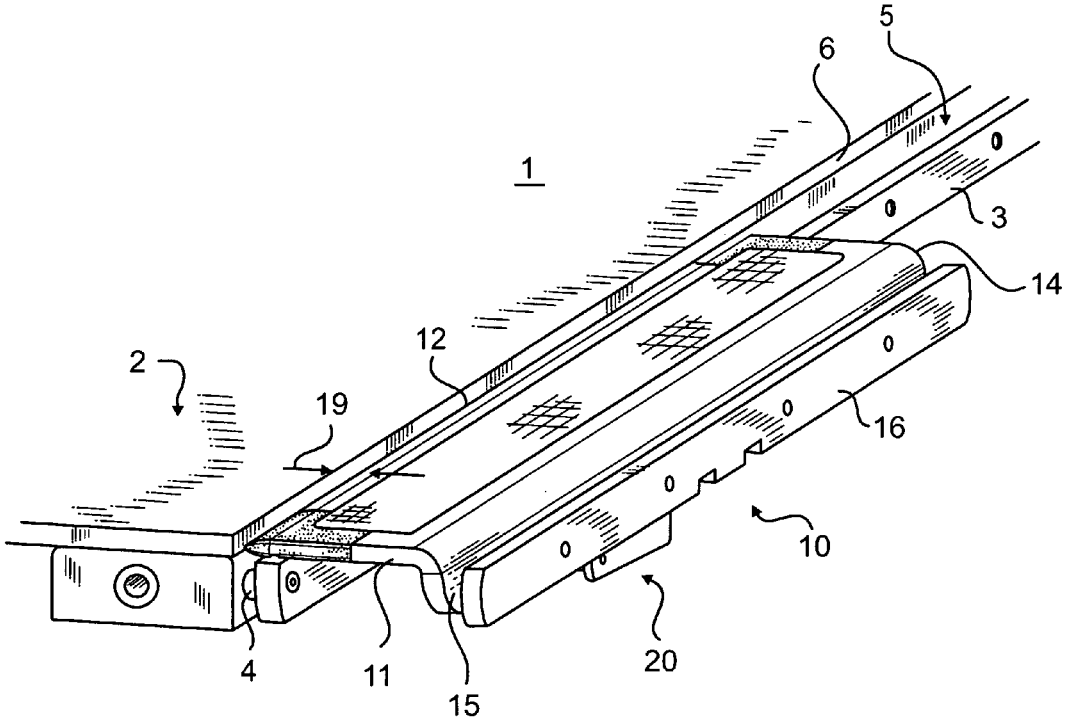
FIG. 1 is a diagrammatic partial perspective view of a surgical table extender according to the invention as mounted upon a surgical table.

Referring now to the drawing, there is shown a surgical table 1 having an upper surface 2 and a laterally mounted table side rail 3 mounted upon a number of stand-offs 4 thereby forming a gap 5 between the table edge 6 and the table side rail 3.

The table width extender 10 is formed by a substantially planar oblong plate 11 having a first edge 12 from which downwardly extends the tang structure 13. Along the opposite lateral edge 14 is a downwardly projecting flange 15 for supporting an extension side rail 16 mounted upon a number of extension stand-offs 17 to create an extension gap 18 between the extension side rail 16 and the extension flange 15. Mounted to the under surface 61 of the plate is a clamp 20 oriented to bear against the table side rail 3 thereby releasably securing the width extension to the table, and to allow the extension to remain secured during use of the table in non-horizontal orientations.

A table width extender 10 is secured to the table by means of an angled tang structure 13 which engages the gap and is cantileverly supported thereby by contacting the upper surface 22 of the table side rail 3 and the lower vertical surface 44 of the table side edge. This allows the top surface of the extender to be substantially within the same plane of the table, and allows the spacing 19 between the upper surface of the table and the upper surface of the extender to be reduced. Through this dual contact mechanism, downward loads applied to the extension create a greater tension force component in the table stand-offs, thereby enhancing the load capability of the table side rail/stand-off assembly.

The plate, tang and flange structures are preferably made from an integrated piece of durable, strong and lightweight material such as a carbon fiber resin composite. The formation of such composites are well-known to those skilled in the art.

Because composites can be susceptible to damage from mechanical shock such as dropping on the floor, the exposed corners 24, 25 of the plate are formed to have the capability of mounting resilient bumpers 26, 27 thereon.

Figure 3:
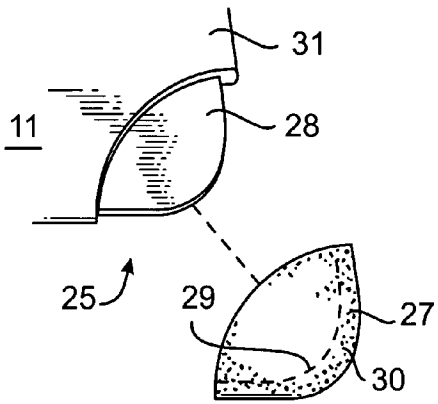
FIG. 3 is a diagrammatic close-up exploded perspective view of the corner bumper feature of the invention.

Referring now to FIG. 3, the corner 25 of the plate 11 can be formed to have a recessed tongue 28 structure which engages a corresponding groove structure 29 in the bumper. This allows the outer surface 30 of the bumper to be commensurate with the exposed outer surface 31 of the plate. The bumper is preferably made from a resilient, durable elastomeric material such as plastic or rubber. The bumper is fastened to the plate using a separate adhesive or can be adhered during formation of the carbon fiber plate using the adhesiveness of the carbon fiber binding matrix material such as epoxy.

Figure 2:
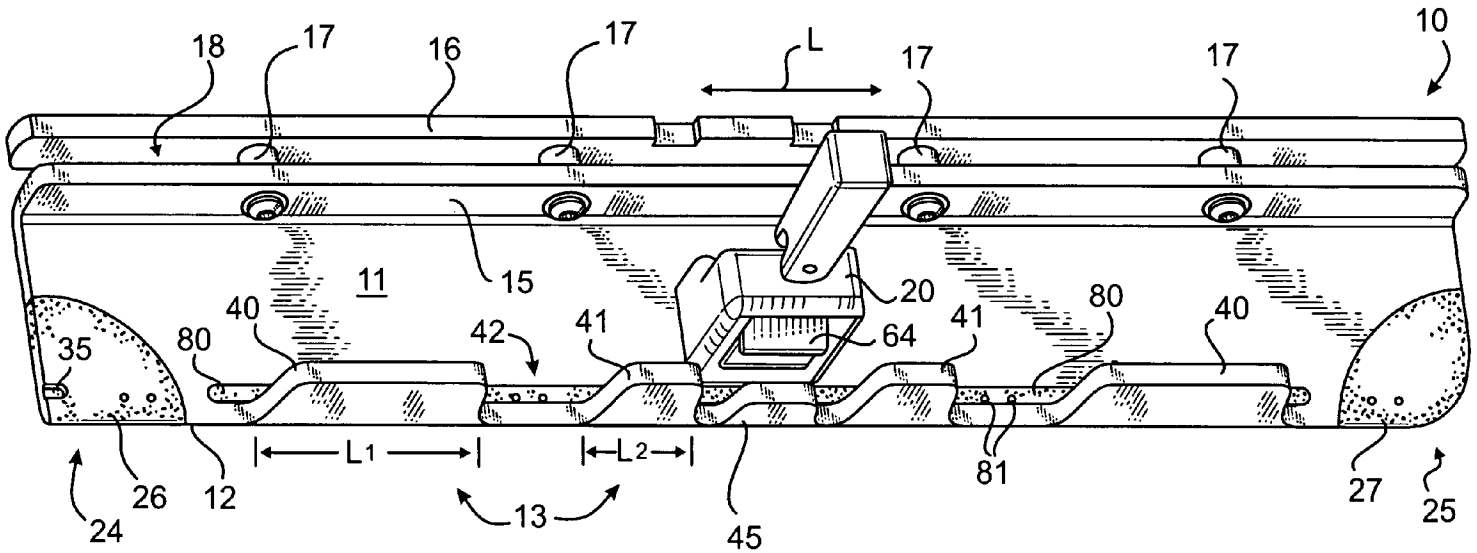
FIG. 2 is a diagrammatic perspective view of the under side of a table extender of FIG. 1.

As shown in FIG. 2, a divot 35 is formed into the under surface of the bumper 26 intended to contact the upper surface of the table side rail. Some surgical table side rails have retractable buttons extending above the flat upper surface of the table side rails. The divot is therefore, sized and positioned to allow the extender to snugly fit to the table side rail over the button. Alternately, the corner 25 of the plate closest to the button can be rounded to avoid contact with the button.

The tang structure 13 of the table extender is formed to allow it to penetrate the gap 5 without interference from the table stand-offs 4. Therefore, the tang structure is formed to have a number of prominences 40, 41. Each pair of adjacent prominences is separated by a notch 42. Therefore, the notch is large enough to fit over a table stand-off. The length of the prominences and the notches in the longitudinal direction L is selected to allow the extension to be placed on tables having non-uniformly spaced-apart table side rail stand-offs and to further allow the extension to be placed universally on either side of the surgical table while still providing adequate surface area for contact at the distal end 43 of the tang with the vertical side surface 44 of the table. Therefore, the most distally located prominences 40 have a length $L_1$ which is longer than the length $L_2$ of the more proximally located prominences 41. This will also result in a symmetrical arrangement of the tang structure moving from a medial position nearest the clamp 20 outward distally to either longitudinal end of the extender.

Each prominence has a substantially planar shape, and all prominences generally lie within the same plane. This plane forms an angle A with any plane P parallel to the plane of the plate 11. For many commonly available surgical tables, the preferred angle has been found to be between about 90 and 110 degrees.

The depth in the vertical direction, the thickness and angle of each prominence is generally a function of the table side rail and stand-off dimensions. However, to adequately increase the tension component in the table stand-offs, the distal end 43 of the tang should extend below the undersurface 21 of the table side rail when the extension is engaged. The exception is where the depth of the center prominence 45 is reduced to make room for the tooth 64 of the clamp structure 20 in the engaged orientation.

Figure 4:
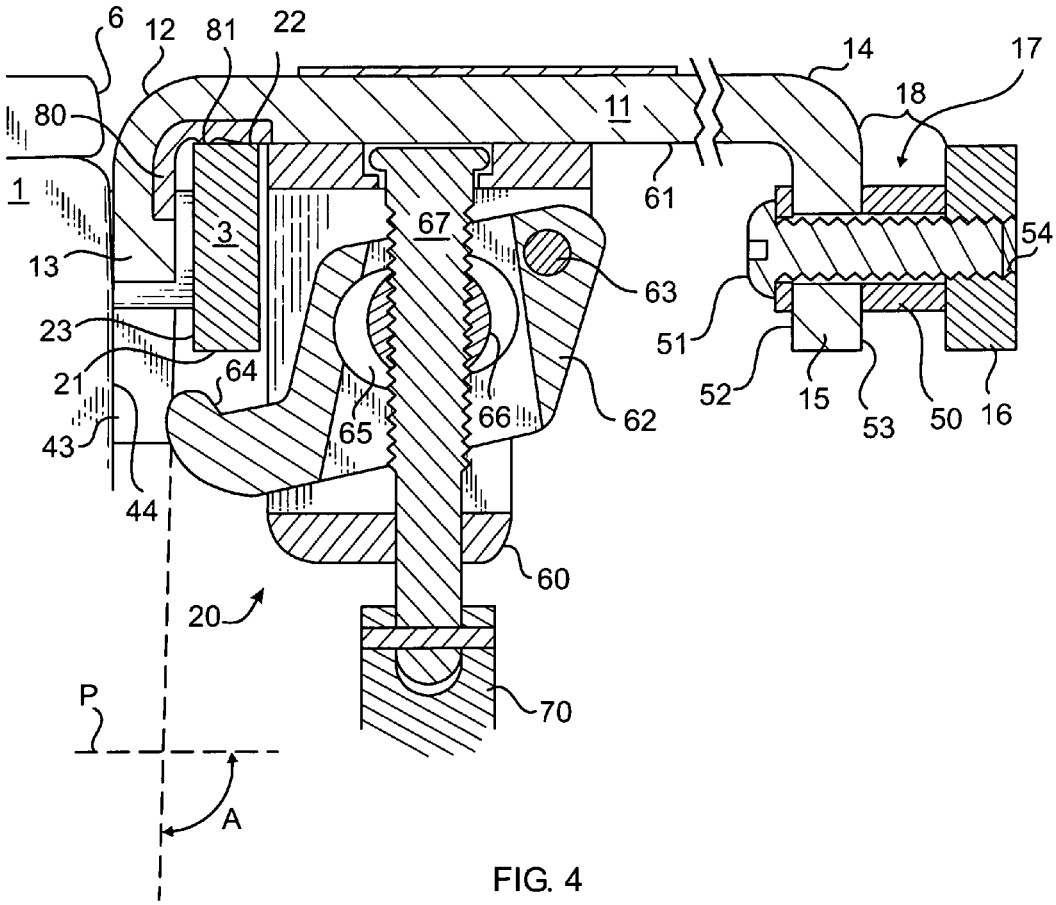
FIG. 4 is a diagrammatic side cross-sectional view of the table extender including view of the clamp mechanism and extender side rail stand-off assembly.

Referring now to FIG. 4, the extender side rail 16 is attached to the extension flange 15 by a number of spaced-apart stand-offs 17. Each stand-off 17 is formed to have a substantially cylindrical stand-off bushing 50 acting as a separator between the rail and the flange. Fastening occurs by use of a screw fastener 51 penetrating from the proximal side 52 of the flange through to the distal side 53 on through the bushing and into a threaded receptor hole 54 in the extension side rail.

Figure 5:
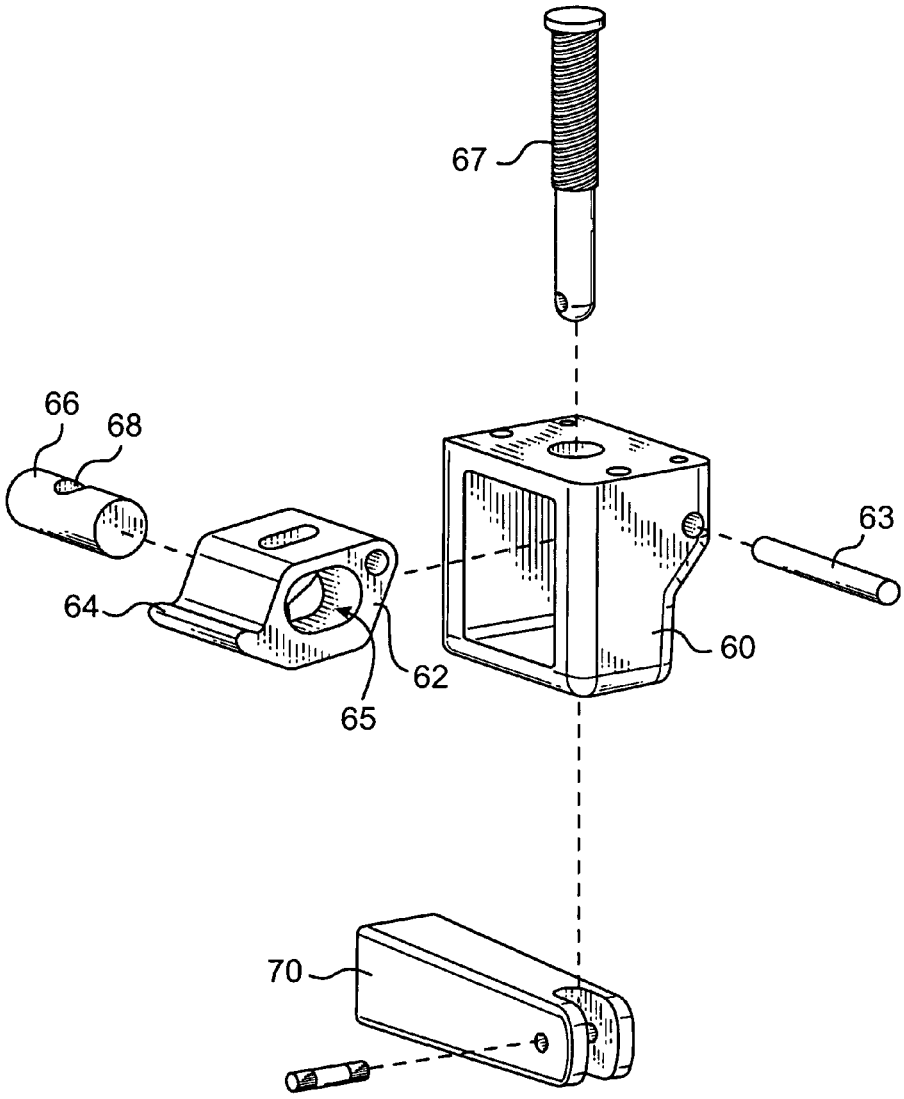
FIG. 5 is a diagrammatic exploded perspective view of the major components of the clamp according to the invention.

Referring now to FIGS. 4 and 5, the preferred clamp structure 20 will now be described. The clamp 20 is formed by a housing 60 which mounts to the underside 61 of the extension plate 11 in a position which allows a jaw 62 to engage the table side rail 3. The jaw is pivotably mounted to the housing 60 at a pivot pin 63. The jaw comprises a jaw body and a tooth 64 for bearing against the table side rail undersurface 21 and the far side vertical surface 23 of the rail facing the table when in the engaged orientation. An oblong, oval bearing slot 65 is formed into the jaw body, the axis of the slot is formed parallel with the axis of the pin 63. A cylindrical rod 66 rotatively and slidingly engages the slot. A threaded drive shaft 67 engages a threaded hole 68 radially penetrating diametrically through the rod. A handle 70 allows rotation of the threaded drive shaft thereby causing the rod to process vertically along the drive shaft. As it does so, it slidingly and rotatingly moves within the oval slot causing rotational motion of the jaw around the axis of the pin.

Referring now to FIG. 4, a protective strip 80 made from a durable hard material such as stainless steel or a durable, resilient elastomeric material such as plastic or rubber is preferably formed in the undersurface of the plate proximal to the tang structure where contact with the table side rail occurs to accommodate the greater stress subjected to this surface. Similarly to the bumper, the protective strip can be adhered to the plate during curing of the plates carbon fiber binding matrix material. For a protective strip made from elastomeric material, a number of longitudinally spaced apart nibs 81 are formed to extend from the undersurface of the protective strip to contact the table side rail. The nibs help prevent, over time, the unwanted adherence between the strip and the table side rail.

Figure 6:
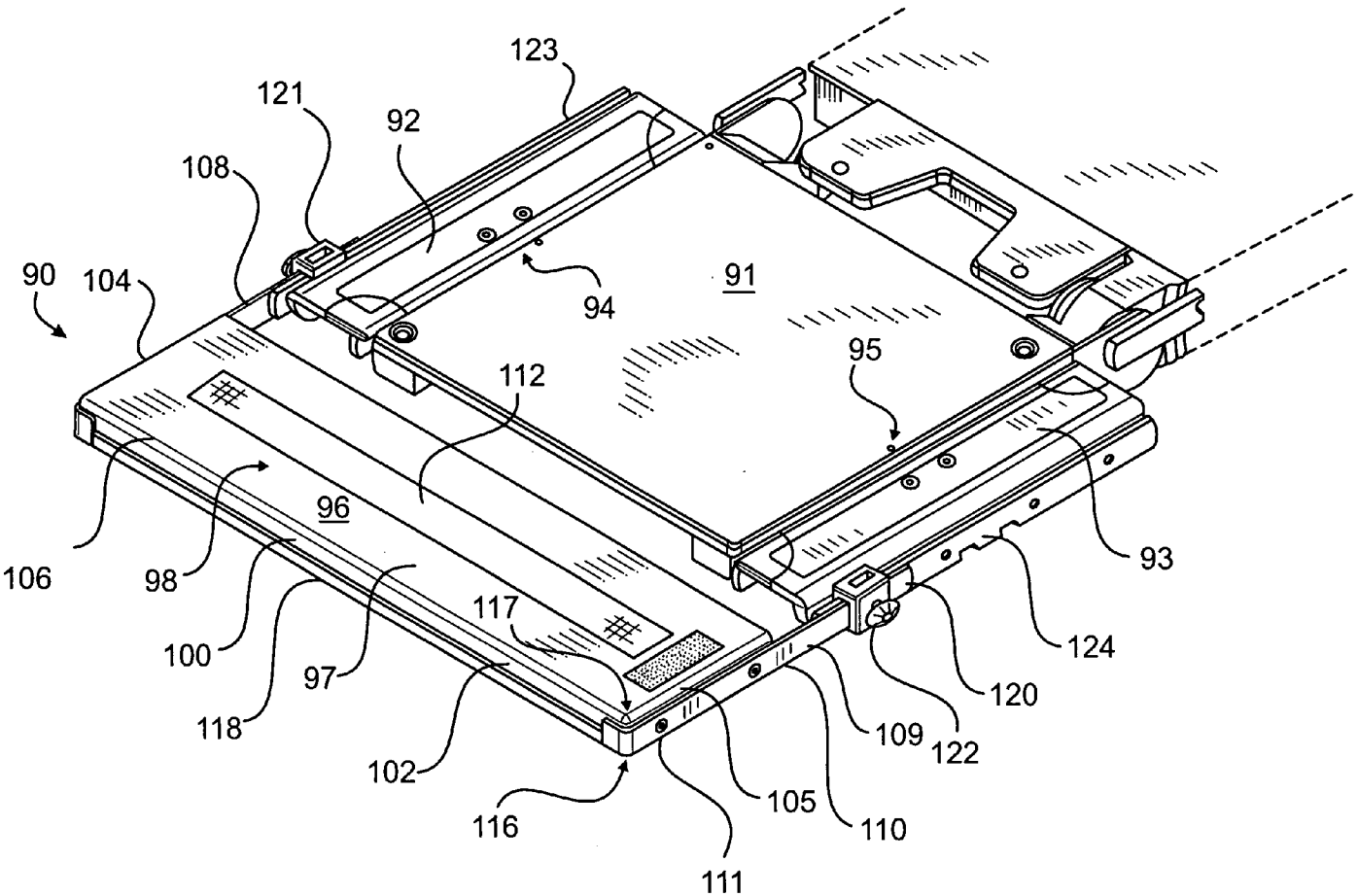
FIG. 6 is a diagrammatic perspective view of the top side end portion of a surgical table having two mounted width extenders and an angularly orientable attachment acting as a table length extender.
Figure 7:
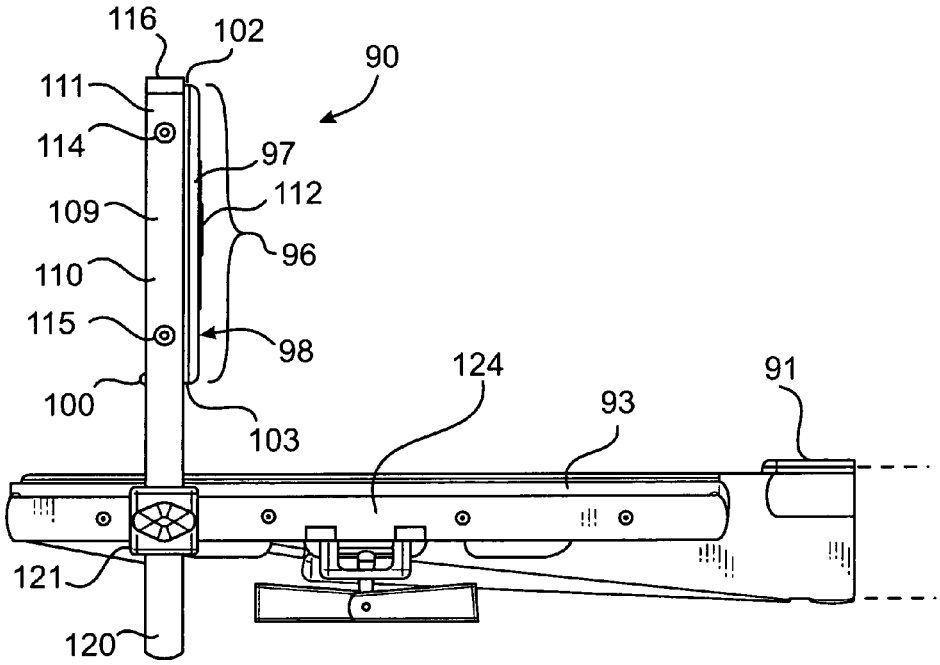
FIG. 7 is a diagrammatic side elevational view of the end portion of a surgical table having two mounted width extenders and an angularly orientable attachment acting as a foot rest.
Figure 8:
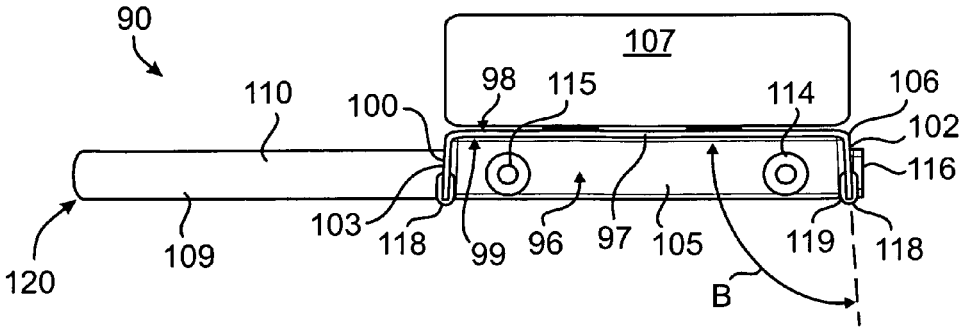
FIG. 8 is a diagrammatic side cross-sectional view of the angularly orientable attachment of FIG. 6 and including a cushion.

Referring now to FIGS. 6–8, there is shown an angularly orientable attachment structure 90 which is attachable to a surgical table 91 having a pair of width extenders 92,93 secured thereto on opposite sides 94,95 of the table in a manner as described above. In FIG. 6, the attachment is shown attached in a lowered, horizontal orientation so that the attachment acts as a table length extender. In FIG. 7, the attachment is shown in a raised, upright orientation where the attachment acts as a foot stop. The attachment is oriented to be substantially 90 degrees from the orientation in FIG. 6.

The attachment 90 has a tray 96 portion formed by an elongated, substantially quadrangular and planar base 97 having front 98 and back 99 surfaces and a stiffening brace 100. The brace is formed by a sidewall structure 101 formed by top 102, bottom 103, and opposite side substantially planar portions 104,105 which extend backwardly from the peripheral edge 106 of the base 97. The angle B formed between the base and the top and bottom sidewall portions is preferably off 90 degrees or non-orthogonal to provide a reduced radiological footprint. The most preferred angle is between about 91 and about 115 degrees. The base and brace are preferably made from an integrated piece of durable, strong, lightweight, and rigid material such as carbon fiber composite material. The formation of such composites are well-known to those skilled in the art. The front surface of the tray is adapted to releasably mount a cushion 107 as shown in FIG. 8 using a patch 112 of hook and loop fabric fastener such as VELCRO brand fastener.

The attachment has a pair of elongated support arms 108,109 which allow the attachment 90 to releasably secure to the in-place width extenders 92,93. Each support arm is formed from an oblong bar 110 of strong, rigid and durable material such as steel. A first proximal end portion 111 of the bar is bonded to the tray 96 by means of a pair of fasteners 114,115 engaging one of the tray sidewall side portions 104,105. A hook 116 is formed onto the end of the bar 110 to protect the corner 117 formed by top and side portions of the sidewall structure. Additionally, a generally U-shaped cross-section protective, molding 118 made from durable, rigid material such as urethane plastic further protects the backward edge 119 of the sidewall.

An opposite distal end portion 120 of the bar 110 is sized to engage a slotted engagement clamp 121,122 releasably attached to each of the extension side rails 123,124. Such clamps are commercially available under the brand name AMSCO by Steris Corporation of Mentor, Ohio. These clamps allow engagement from mutually orthogonal directions corresponding to the two attachment orientations described above.

While the preferred embodiments of the invention have been described, modifications can be made and other embodiments may be devised without departing from the spirit of the invention and the scope of the appended claims.

What is claimed is:

1. A combination of a surgical table and an extension, wherein said table comprises:
- a table top having a peripheral table rim defining a vertical side surface;
- a plurality of table stand-offs projecting horizontally from said rim;
- a table side rail mounted to said stand-offs forming a gap therebetween;
- wherein said extension comprises:
  - a plate having first and second edges;
  - a tang structure extending downwardly from said first edge and having a distal end;
  - said distal end being engaged downwardly through said gap, wherein said distal end contacts said side surface below said table stand-offs; and
  - an extension side rail mounted to said second edge on a plurality of extension stand-offs.

2. The combination of claim 1, wherein said first and second edges are located opposite one another.

3. The combination of claim 1, wherein said tang structure comprises a plurality of prominences wherein a first adjacent pair of said prominences are separated by a first notch being sized to fit over a first one of said table stand-offs.

4. The combination of claim 3, wherein said table stand-offs are not uniformly spaced apart, and a second adjacent pair of said prominences are separated by a second notch wherein said first notch is larger than said second notch, thereby allowing said extension to mount in a plurality of positions between non-uniformly spaced-apart table stand-offs.

5. The combination of claim 3, wherein said prominences are substantially planar lying within a first plane and said plate is substantially planar lying within a second plane, wherein said first plane and said second plane are oriented at a first angle to one another.

6. The combination of claim 5, wherein said angle is between about 90 and 110 degrees.

7. The combination of claim 3, wherein said tang structure and a lower surface portion of said plate together form a dual bearing surface engagement structure.

8. The combination of claim 7, wherein said lower surface portion is located to contact a top surface of said table rail; and
- wherein a first of said prominences comprises a proximal end attached to said first edge and a distal end portion having a bearing surface for contacting said table top peripheral rim when said extension is releasably attached to said table.

9. The combination of claim 8, wherein said extension further comprises a protective strip formed into said lower surface portion of said plate.

10. The combination of claim 1, which further comprises a clamp mechanism mounted to said extension and being sized, shaped and positioned to engage a portion of said table side rail.

11. The combination of claim 1, wherein said plate and tang structure are made from a contiguous piece of composite material.

12. The combination of claim 11, wherein said composite material comprises a carbon fiber and resin composite.

13. A combination of a surgical table and an extension, wherein said table comprises:
- a table top having a peripheral table rim;
- a table side rail mounted to said table rim on a plurality of table stand-offs forming a gap therebetween;
- wherein said extension comprises:
  - a plate having first and second edges;
  - a tang structure extending downwardly from said first edge;
  - said tang structure being sized and shaped to engage said gap;
  - an extension side rail mounted to said second edge on a plurality of extension stand-offs; and
  - a clamp mechanism sized, shaped and positioned to engage a portion of said table side rail;
- wherein said clamp mechanism comprises:
  - a housing;
  - a jaw pivotally mounted upon a pin to said housing, said jaw comprising a jaw body and a tooth;
  - an oblong slot formed into said jaw body;
  - said slot being oriented coaxially with said pin;
  - a rod rotatively and slidingly engaged in said slot; and
  - a threaded drive shaft engaging a threaded hole radially penetrating said rod,
  - thereby allowing sliding and rotating movement of said rod relative to said slot causing pivoting movement of said jaw relative to said housing during axial rotation of said shaft.

14. The combination of claim 13, wherein a portion of said jaw bears against a far side of said rail when the jaw is in an engaged orientation.

15. A combination of a surgical table and an extension, wherein said table comprises:
- a table top having a peripheral table rim;
- a table side rail mounted to said table rim on a plurality of table stand-offs forming a gap therebetween;
- wherein said extension comprises:
  - a plate having first and second edges;
  - a tang structure extending downwardly from said first edge;

said tang structure being sized and shaped to engage said gap; and an extension side rail mounted to said second edge on a plurality of extension stand-offs;

wherein said tang structure comprises a plurality of prominences wherein a first adjacent pair of said prominences are separated by a first notch being sized to fit over a first one of said table stand-offs;

said tang structure and a lower surface portion of said plate together form a dual bearing surface engagement structure;

said lower surface portion is located to contact a top surface of said table rail;

a first of said prominences comprises a proximal end attached to said first edge and a distal end portion having a bearing surface for contacting said table top peripheral rim when said extension is releasably attached to said table;

said extension further comprises a protective strip formed into said lower surface portion of said plate; and said strip is made from an elastomeric material.

16. The combination of claim 15, wherein said strip comprises a plurality of nibs extending from a surface of said strip.

17. A combination of a surgical table and an extension, wherein said table comprises:

a table top having a peripheral table rim;

a table side rail mounted to said table rim on a plurality of table stand-offs forming a gap therebetween;

wherein said extension comprises:

a plate having first and second edges;

a tang structure extending downwardly from said first edge;

said tang structure being sized and shaped to engage said gap;

an extension side rail mounted to said second edge on a plurality of extension stand-offs; and said plate being formed to have a corner tongue, and a bumper formed from a resilient, durable material, and having a cavity engaged by said tongue.

18. The combination of claim 17, wherein said bumper is shaped to have a divot for accommodating a button extending from said table side rail.

19. A combination of a surgical table and an extension, wherein said table comprises:

a table top having a peripheral table rim;

a table side rail mounted to said table rim on a plurality of table stand-offs forming a gap therebetween;

wherein said extension comprises:

a plate having first and second edges;

a tang structure extending downwardly from said first edge;

said tang structure being sized and shaped to engage said gap; and an extension side rail mounted to said second edge on a plurality of extension stand-offs;

an angularly orientable attachment structure, said attachment structure comprises:

a tray comprising:

a base; and, a stiffening brace extending from said base;

a first oblong support arm having a first end portion bonded to said tray, and a second end portion shaped and dimensioned to releasably engage an engagement assembly mounted to said extension side rail.

20. The combination of claim 19, wherein said attachment structure further comprises a second oblong support arm bonded to said tray a distance apart from said first arm.

21. The combination of claim 20, wherein said distance is commensurate with said table having two of said extensions, each mounted on opposite sides of said table and wherein said first arm engages a first engagement assembly associated with a first extension and a second arm engages a second engagement assembly associated with a second extension.

22. The combination of claim 19, wherein an angle formed between said base and said brace is selected to be non-orthogonal, thereby reducing a radiological footprint of said tray.

* * * * *